US011471363B1

(12) United States Patent
Semesnyei et al.

(10) Patent No.: US 11,471,363 B1
(45) Date of Patent: Oct. 18, 2022

(54) POSITION-ADJUSTABLE ACCESSORY HANDLE DEVICE FOR FACILITATED OPERATION OF A ROLLATOR

(71) Applicants: Tivadar A. Semesnyei, West Seneca, NY (US); Merry Riehm-Constantino, Buffalo, NY (US); Alexander T. Reding, Lockport, NY (US)

(72) Inventors: Tivadar A. Semesnyei, West Seneca, NY (US); Merry Riehm-Constantino, Buffalo, NY (US); Alexander T. Reding, Lockport, NY (US)

( * ) Notice: Subject to any disclaimer, the term of this patent is extended or adjusted under 35 U.S.C. 154(b) by 0 days.

(21) Appl. No.: 17/072,873

(22) Filed: Oct. 16, 2020

(51) Int. Cl.
*A61H 3/04* (2006.01)

(52) U.S. Cl.
CPC ..... *A61H 3/04* (2013.01); *A61H 2201/0192* (2013.01); *A61H 2201/1635* (2013.01)

(58) Field of Classification Search
CPC ..... A61H 3/04; A61H 2201/0192; A61H 2201/1635
See application file for complete search history.

(56) References Cited

U.S. PATENT DOCUMENTS 4,248,256 A 2/1981 Thomas
4,411,283 A 10/1983 Lucarelli
4,748,994 A 6/1988 Schultz
5,603,517 A 2/1997 Lorman
5,657,783 A 8/1997 Sisko
6,099,002 A 8/2000 Uchiyama
6,338,355 B1 * 1/2002 Cheng ..... A61H 3/04 482/68
6,378,883 B1 * 4/2002 Epstein ..... A61H 3/04 180/65.6
6,990,990 B2 1/2006 Wilensky
8,251,079 B1 * 8/2012 Lutz ..... A61H 3/04 135/67
9,808,394 B1 * 11/2017 Jiang ..... A61H 3/04
2002/0084397 A1 * 7/2002 Ross, Jr. ..... A63D 15/10 248/113
2004/0079405 A1 * 4/2004 Sanders ..... A61H 3/04 135/67
2004/0104559 A1 * 6/2004 Chen ..... A61H 3/04 280/642
2005/0156395 A1 6/2005 Bohn
(Continued)

*Primary Examiner* — Erez Gurari
(74) *Attorney, Agent, or Firm* — Vincent G. LoTempio

(57) ABSTRACT

A position-adjustable accessory handle device helps a user maneuver a rollator. The handle device provides an arced handle bar that detachably fastens to a rollator handle, serving as an extension. An adjustment bracket fits between handle bar and rollator handle, allowing the handle bar to adjustably articulate in height and angle, relative to the rollator handle. The handle bar has a short proximal section and a long distal section. An arced bridge extends therebetween. The bridge orients the proximal section towards the user, and allows for fastening to different rollators. The proximal section of handle bar has a grip member for gripping. Fastening holes form in the distal section of handle bar. An adjustment bracket fits between handle bar and rollator handle. This creates frictionless pivoting articulation of the handle bar; and to enable the handle bar to be fixedly oriented at a set angle relative to rollator handle.

20 Claims, 6 Drawing Sheets

(56) References Cited

U.S. PATENT DOCUMENTS

| | | | | |
|---|---|---|---|---|
| 2007/0096436 | A1* | 5/2007 | Willis | A61G 5/128 280/650 |
| 2007/0283990 | A1* | 12/2007 | Fernandez | A61G 5/128 280/87.041 |
| 2009/0033052 | A1* | 2/2009 | Bradshaw | A61H 3/04 280/47.36 |
| 2010/0083994 | A1* | 4/2010 | Liu | A61G 5/02 135/67 |
| 2011/0241303 | A1* | 10/2011 | Campbell | A45B 9/02 280/87.041 |
| 2012/0223509 | A1* | 9/2012 | Gaudiano | A61H 3/04 280/647 |
| 2013/0113187 | A1* | 5/2013 | Willis | A61G 5/08 280/649 |
| 2016/0106617 | A1* | 4/2016 | Wobith | A61G 5/1002 280/643 |
| 2016/0250095 | A1* | 9/2016 | Liu | A61H 3/04 280/47.38 |
| 2017/0008544 | A1* | 1/2017 | Kindberg | B62B 7/062 |
| 2017/0352288 | A1* | 12/2017 | Weffers-Albu | A61H 3/00 |
| 2018/0028392 | A1* | 2/2018 | Bisceglia | A61H 3/04 |
| 2019/0142666 | A1* | 5/2019 | Virgo | A45B 7/00 135/67 |
| 2019/0151185 | A1* | 5/2019 | Kirschey | A61G 5/047 |
| 2020/0008990 | A1* | 1/2020 | Harrison | B62K 5/025 |
| 2020/0155408 | A1* | 5/2020 | Fathi | A61H 1/00 |
| 2020/0315901 | A1* | 10/2020 | Fellingham | A61H 3/04 |
| 2020/0406947 | A1* | 12/2020 | Hofmann | B62B 3/04 |
| 2021/0393471 | A1* | 12/2021 | Munton | A47K 13/10 |

* cited by examiner

POSITION-ADJUSTABLE ACCESSORY HANDLE DEVICE FOR FACILITATED OPERATION OF A ROLLATOR

FIELD OF THE INVENTION

The present invention relates generally to a position-adjustable accessory handle device for facilitated operation of a rollator. More so, the present invention relates to an accessory handle device that detachably attaches to a rollator in multiple adjustable heights and angles, so as to help a user in mounting, demounting, and maneuvering a rollator. The position-adjustable handle device provides an arced handle bar that detachably fastens to a rollator handle, serving as an extension thereto. An adjustment bracket fits between the handle bar and the rollator handle, allowing the handle bar to adjustably articulate in height and angle, relative to the rollator handle.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, walkers are used tools configured to help in walking and standing upright. Often, the walker assists the aged, handicapped, injured, or otherwise experience difficulty in walking normally and require some kind of stabilizing assistance. In general, walkers include a generally U-shaped top frame member, having a base section and two arm sections supported horizontally at a convenient height above the ground by four legs extending rigidly downwardly from the two corner regions and the ends of the two arm sections. The legs are braced at one or more intermediate points along their length either by bracing members extending between the two corner region legs and between each corner region leg and the corresponding end leg. The handles of the walker are oriented to be gripped by the user. Further, a rollator is a type of walker having wheels, such that the walker rolls or glides across the ground surface.

Other proposals have involved walker extension bar accessories. The problem with these extension accessories is that they do not adjust in height and angle relative to the user. Also, they are not configured for attachment to a rollator. Even though the above cited walker extension bar accessories meet some of the needs of the market, a position-adjustable accessory handle device for facilitated operation of a rollator that detachably attaches to a rollator in multiple adjustable heights and angles, so as to help a user in mounting, demounting, and maneuvering a rollator, is still desired.

SUMMARY

Illustrative embodiments of the disclosure are generally directed to a position-adjustable accessory handle device that helps a user in mounting, demounting, and maneuvering a rollator. The position-adjustable handle device provides an arced handle bar that detachably attaches to a rollator in multiple adjustable heights and angles, so as to help a user in mounting, demounting, and maneuvering a rollator. The position-adjustable handle device provides an arced handle bar that detachably fastens to a rollator handle, serving as an extension thereto. An adjustment bracket fits between the handle bar and the rollator handle, allowing the handle bar to adjustably articulate in height and angle, relative to the rollator handle.

In some embodiments, the position-adjustable accessory handle device comprises at least one handle bar that has a short proximal section and an opposing long distal section. An arced bridge extends therebetween. The proximal section of the handle bar has a grip member for enhanced gripping and manipulation of the rollator. Multiple spaced-apart fastening holes form in the distal section of the handle bar.

The arced bridge forms an angle that orients the proximal section towards the user, and allows for fastening to different brands of rollators, having different styles, angles, and heights of rollator handles. The at least one handle bar has interchangeable dimensions, such as differently angled bridges that achieve different orientations of the proximal section relative to the rollator handle.

At least one adjustment bracket fits between the handle bar and the rollator handle. The adjustment bracket is configured to create a frictionless pivoting articulation of the handle bar relative to the rollator handle. The adjustment bracket is also configured to enable the handle bar to be fixedly oriented at a set angle relative to the rollator handle. In this manner, the adjustment bracket allows the handle bar to be positioned in at least four angle adjustment positions relative to the rollator handle.

The adjustment bracket fixedly attaches the handle bar to the frame of the rollator through use of a first and second mount hole that align with the rollator fastening holes. Similarly, the bracket holes in the adjustment bracket, and the fastening holes in the distal section of the handle bar are aligned to a desired height for the handle bar.

The device also provides a fastener that passes through the aforementioned holes, so as to secure the adjustment bracket to the rollator handle, and to fixedly set the height and position of the handle bar relative to the adjustment bracket. The fastener passes through the rollator fastening holes, the mount holes, the bracket holes and the fastening holes to fix the orientation of the handle bars.

The handle attaches to the adjustment bracket by selectively passing and fastening the fastener to one of the bracket holes and fastening holes, at a desired length and angle. Furthermore, at least one spacer can be used to separate the adjustment bracket from the handle bar to prevent frictional interference therebetween.

The fasteners may include, without limitation, threaded bolts, butterfly screws, winged bolt, nuts, and friction fit fasteners. In one embodiment, the fasteners are configured to be turned with a coin or fingers through use of a slot at the ends, and a butterfly screw at an opposing end. The fastener is loosened to realign the fastening holes and bracket holes. The fastener is also loosened to adjust the angle of the handle bar for manipulation of the rollator.

One objective of the present invention is to provide an adjustable accessory handle that attaches to a rollator handle and that can be set at an ideal height for manipulating a rollator.

Another objective is to provide an adjustable accessory handle that attaches to a rollator handle and that can be set at an ideal angle for manipulating a rollator.

Yet another objective is to allow a user to stop and rest while using the rollator, by either standing upright or leaning the elbows on the handles.

Additional objectives are to allow the user to rest the arms while also improving posture during operation of the rollator.

An exemplary objective is to provide an adjustable bracket that orients the handle bar at four different angular positions.

provide an accessory handle that is easy to attach to multiple styles and sizes of rollators.

Yet another objective is to provide an inexpensive to manufacture position-adjustable accessory handle device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A position-adjustable accessory handle device 200 is referenced in FIGS. 1-6. Position-adjustable accessory handle device 200, hereafter "device 200" detachably attaches to a rollator 100 at multiple heights and angles, relative to the user and the rollator 100. This creates myriad handle extensions to rollator 100, which serves to assist a user in mounting, demounting, standing, sitting, turning, and generally maneuvering while using the rollator 100 for support.

Figure 1:
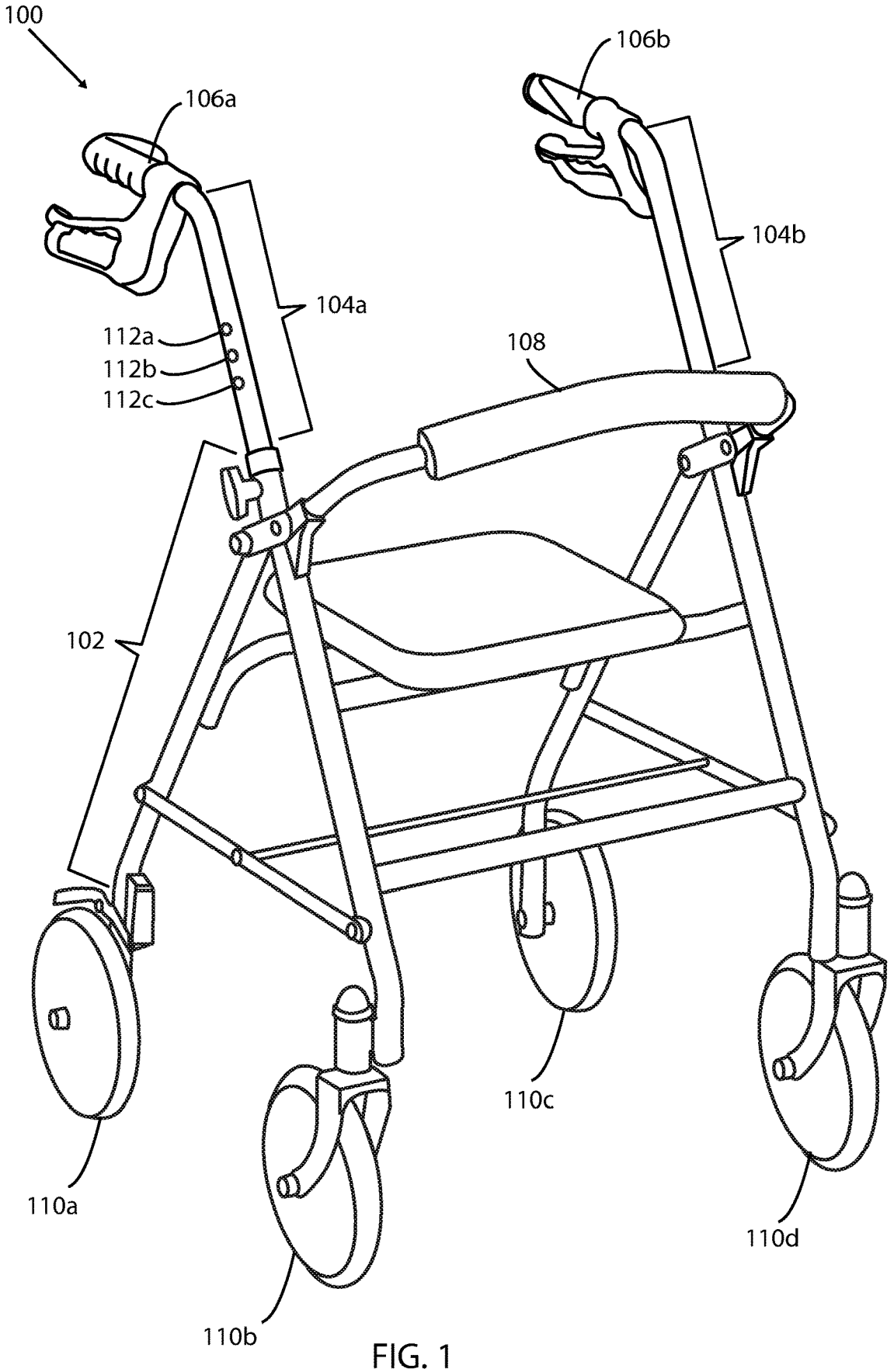
FIG. 1 illustrates a perspective view of an exemplary rollator, in accordance with an embodiment of the present invention.

Looking initially at FIG. 1, device 200 is operable with a rollator 100. Device 200 is scalable, so as to attach to any type or size of rollators. In alternative embodiments, rollator 100 is part of the invention, such that a rollator with an extension handle device 200 is taught. It is known in the art that a rollator 100 is a type of walker that assists elderly, disabled, and children in walking, sitting, standing, turning, and general maneuverability motions.

As illustrated in FIG. 1, rollator 100 includes a frame 102 that provides the structural integrity. Frame 102 may include opposing bottom and top ends, with support crossbars that run vertically and horizontally. Four legs extend rigidly downwardly from the two corner regions of bottom end. The termini of the legs may utilize multiple wheels 110*a*, 110*b*, 110*c*, 110*d*, rollers, or other mobility components. In one embodiment, frame 102 also includes a support bar 108 that allows the user to lean back while being supported on the rollator. However, a support belt or other user fastening mechanisms may also be used to help keep the user upright while operating the rollator.

Continuing with FIG. 1, rollator 100 provides a pair of rollator handles 104*a*-*b* that extend from the upper end of the frame. Rollator handles 104*a*-*b* may curve inwardly, towards the user for easy gripping at a pair of rollator grips 106*a*, 106*b*. Furthermore, rollator handles 104*a*-*b* form multiple rollator fastening holes 112*a*, 112*b*, 112*c* that enable passage of a fastener, so that device 200 can mount thereto.

Device 200 is configured to detachably attach to the rollator handles 104*a*-*b* at multiple adjustable heights and angles, relative to the rollator handles 104*a*-*b*. Device 200 is also configured with an arced bridge 208, so as to bend towards the user for easy gripping and maneuverability. The arc, or bend, of device 200 is fixed at an arc angle. Furthermore, device 200 is configured to height-adjust in small, 1" increments for usability by users of different arm lengths and heights. In this manner, the user can also stop and rest while using the rollator, by either standing upright or leaning the elbows on the handle bars 202 that extend from the rollator handles 104*a*-*b*. Furthermore, an adjustment bracket 216 fits between the handle bar 202 and the rollator handle, serving as a friction negator that allows the handle bar 202 to adjustably articulate in height and angle, relative to the rollator handle and the user.

Looking at the handle bars known in the art, FIGS. 4A-4F illustrate the multiple types, angles, and dimensions of handle bars that fixedly attach to existing rollators in the market. The existing rollator handle bars do not have the adjustable plate 214*c*; and thus, cannot accommodate differently sized users and rollators. For example, existing rollators show handle bars 400, 402, 404, 406, 408, 410 having differently sized proximal and distal sections, and different arc angles. Each configuration of handle bars 400-410 is fixed, and does not have the adjustability, due to the lack of an adjustable plate.

Existing rollators have telescoping handles to accommodate different user heights. The telescoping section is what is illustrated in FIGS. 4*a*-4*f*. They are limited to how high they can telescope because the handles will extend beyond the wheel-base of the rollator and the user could press down and tip the rollator over. Thus, FIGS. 4A-4F Illustrate perspective views of the multitude of rollators handles to which the current embodiment of the present invention can attach. The current embodiment causes no tipping danger because the top of the handle is attached in a way that the user has a higher handle on an existing rollator but the handle does not extend out beyond the wheelbase. The user can safely rest their arms and straighten their bodies using the current embodiment.

Figure 4A:
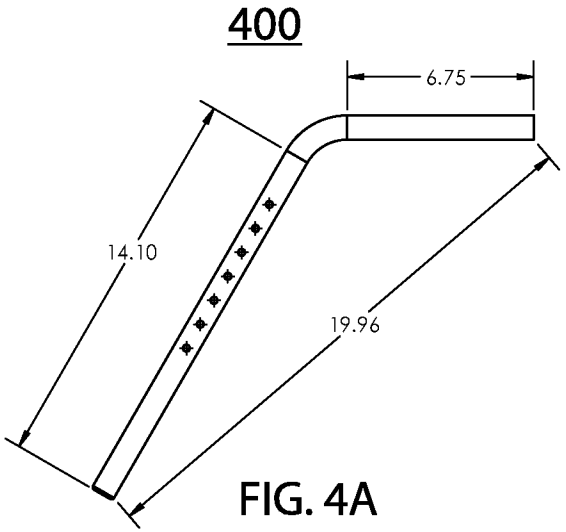
FIGS. 4A-4F illustrate perspective views of existing art handle bars that fixedly attach to rollators, in accordance with an embodiment of the present invention.
Figure 4B:
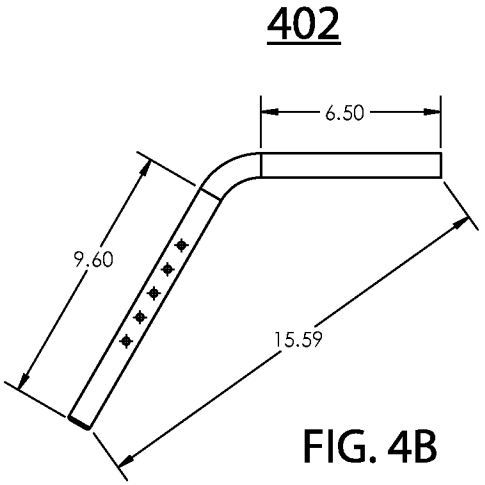
Figure 4C:
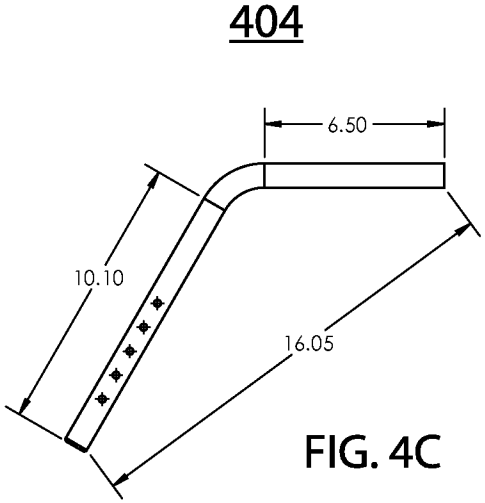
Figure 4D:
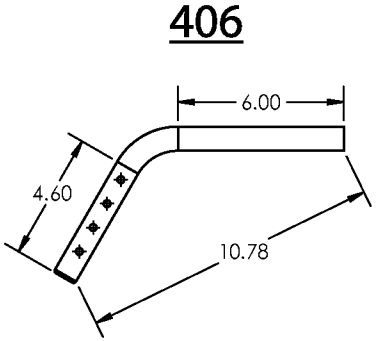

As illustrated in FIG. 4A, an existing first rollator handle bar 400 that has a proximal section of 6.75" and a distal section of 14.10". The distance between the termini of the proximal and distal sections is 19.96". As FIG. 4B shows, a second handle bar 402 has a proximal section of 6.50" and a distal section of 9.60". The distance between the termini of the proximal and distal sections is 15.59". Looking at FIG. 4C, a third handle bar 404 has a proximal section of 6.50" and a distal section of 10.10". The distance between the termini of the proximal and distal sections is 16.05".

Figure 4E:
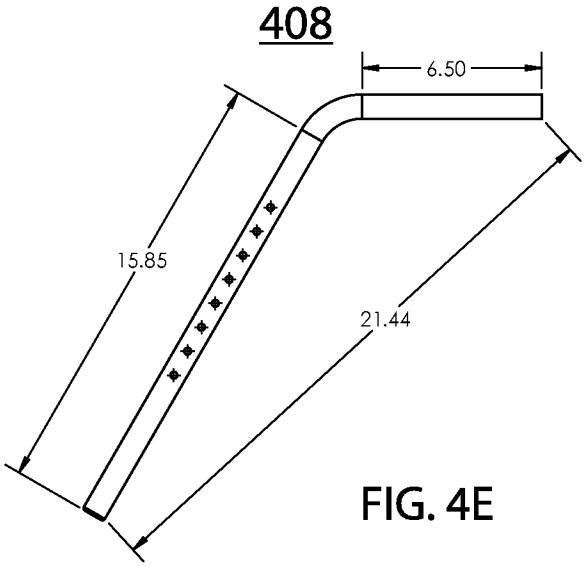
Figure 4F:
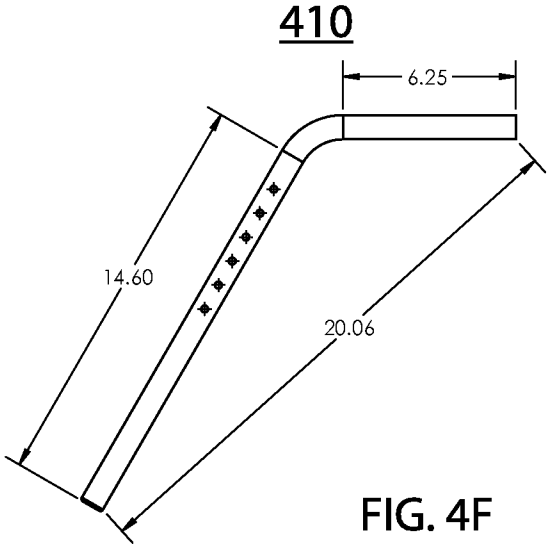

An example of an existing rollator handle bars that is shorter. This is shown in a fourth handle bar 406 that has a proximal section of 6.00" and a distal section of 4.60". The distance between the termini of the proximal and distal sections is 10.78" (See FIG. 4D). A handle bar for shorter users is longer. This is illustrated in FIG. 4E, showing a fifth handle bar 408 has a proximal section of 6.50" and a distal section of 15.85". The distance between the termini of the proximal and distal sections is 21.44". Finally, FIG. 4F references a sixth handle bar 410 has a proximal section of 6.25" and a distal section of 14.60". The distance between the termini of the proximal and distal sections is 20.06". However, in alternative embodiment, different lengths and arc radii may be used to accommodate different rollators and users.

Figure 2:
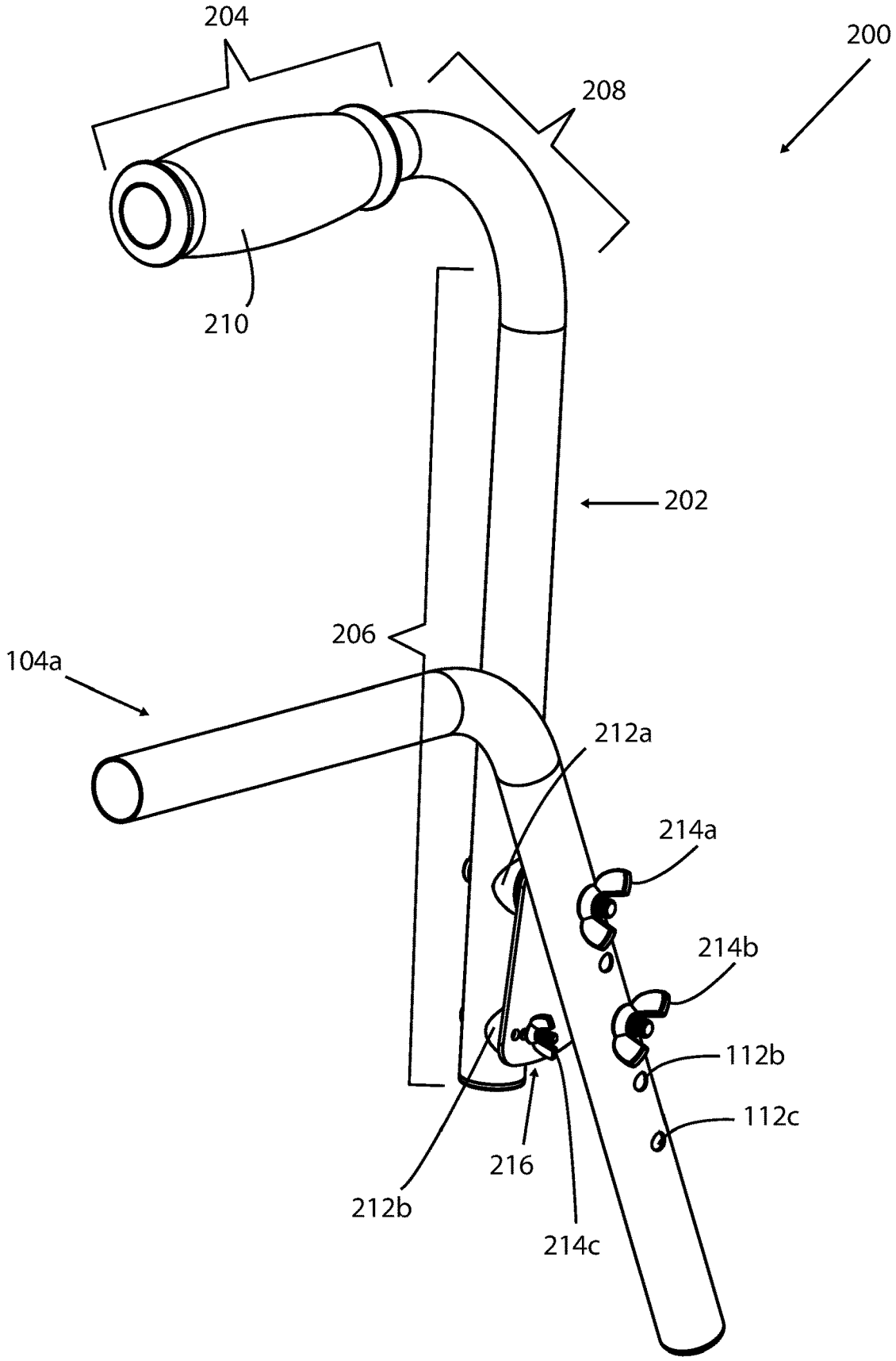
FIG. 2 illustrates an inner perspective view of an exemplary position-adjustable accessory handle device attached to a rollator handle, in accordance with an embodiment of the present invention.
Figure 3:
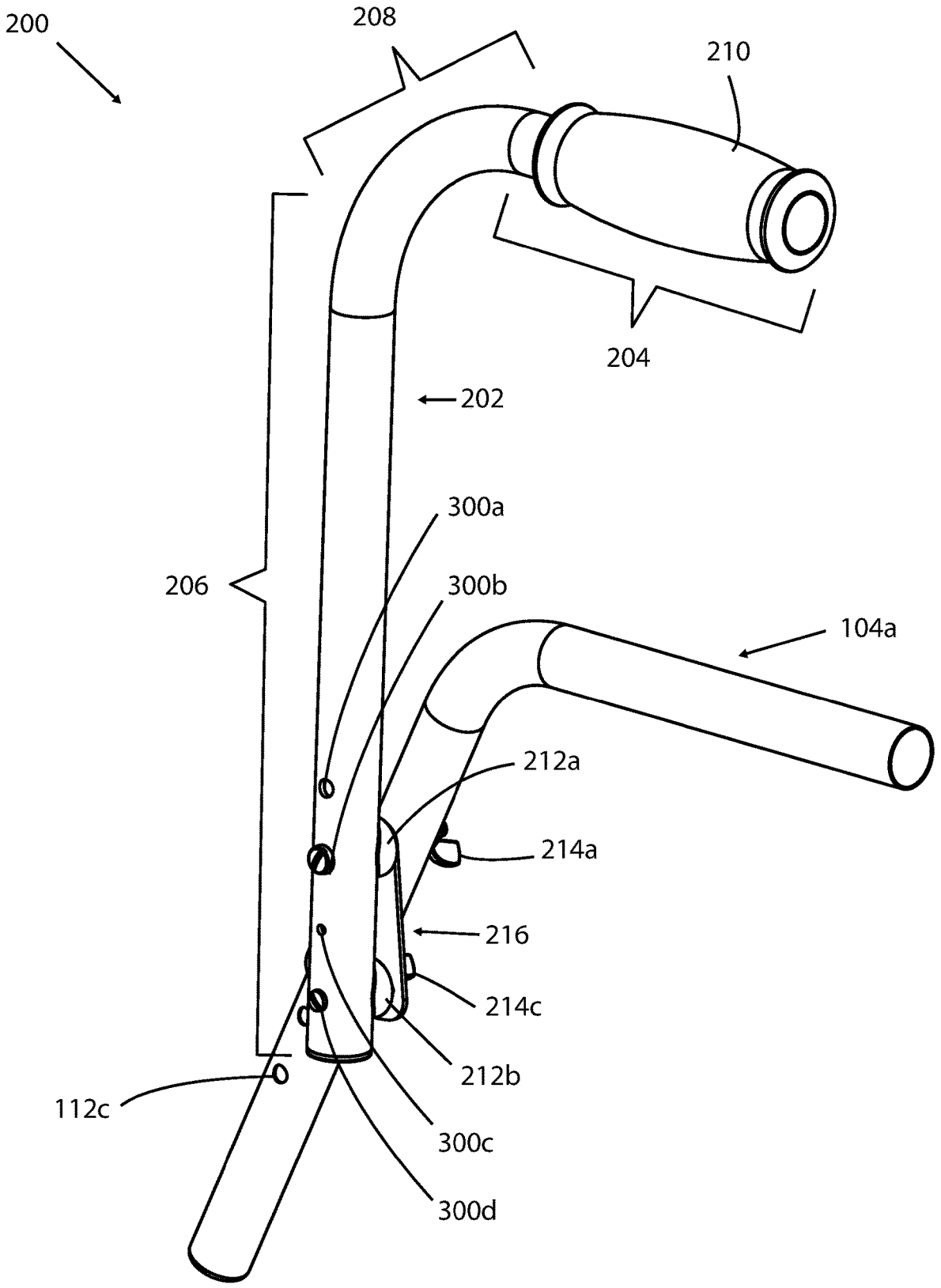
FIG. 3 illustrates an outer perspective view of an exemplary position-adjustable accessory handle device attached to a rollator handle, in accordance with an embodiment of the present invention.

Turning now to FIG. 2, device 200 comprises at least one handle bar 202, which has a generally elongated, cylindrical, and arced shape. Handle bar 202 is greppable from a proximal section 204, and detachably attachable to the rollator handle from a distal section 206. For example, FIGS. 2-3 illustrate inner and outer perspective views of handle bar 202 attached to a rollator handle 104*a*. Proximal section 204 is generally closer to the user during gripping of the device 200. In one possible embodiment, distal section 206 is longer than proximal section 204. Handle bar 202 may have a tubular shape that requires end caps at the termini to close off openings. Suitable materials for handle bar 202 may include, without limitation, aluminum, steel, metal alloys, a rigid polymer, and wood.

Further, an arced bridge 208 extends between the proximal and distal sections 204, 206. The arc radius of arced bridge 208 is fixed, but multiple interchangeable handle bars 202 can be used with the rollator handle to achieve different angles and lengths. In one embodiment, multiple handle bars with the different arced bridges defined by unique arc angles are interchangeably fastened to the rollator handle.

This use of multiple arc radii and lengths for the proximal and/or distal sections 204, 206 allows the handle bar 202 to accommodate different heights and arm lengths for the users. For example, a short user, or child, may require a longer proximal section 204 for the handle bar 202, and a greater arc angle for the arced bridge 208. This handle bar configuration 408, shown in FIG. 4E, creates additional extension to meet the hands of the short user.

In some embodiments, proximal section 204 of handle bar 202 is compatible with a grip member 210. In one embodiment, grip member 210 that slides onto the terminus of the proximal section 204. Grip member 210 is used for enhanced gripping and manipulation of the rollator. In one non-limiting embodiment, grip member 210 has a textured surface. In other embodiments, multiple spaced-apart fastening holes 300*a*, 300*b*, 300*c*, 300*d* form in the distal section 206 of the handle bar 202. Fastening holes 300*a*-*d* are configured and spaced, so as to align with correlating bracket holes, discussed below, As FIG. 4 illustrates, arced bridge 208 forms an angle, or arc radius, that orients proximal section 204 of handle bar 202 towards the user, and allows for fastening to different brands of rollators, having different styles, angles, and heights of rollator handles 104*a*-*b*. In this manner, handle bar 202 may include multiple, interchangeable handle bars 202, having bridge 208*s* with different arc radii that achieve different orientations of the proximal section 204 relative to the rollator handle.

Figure 5:
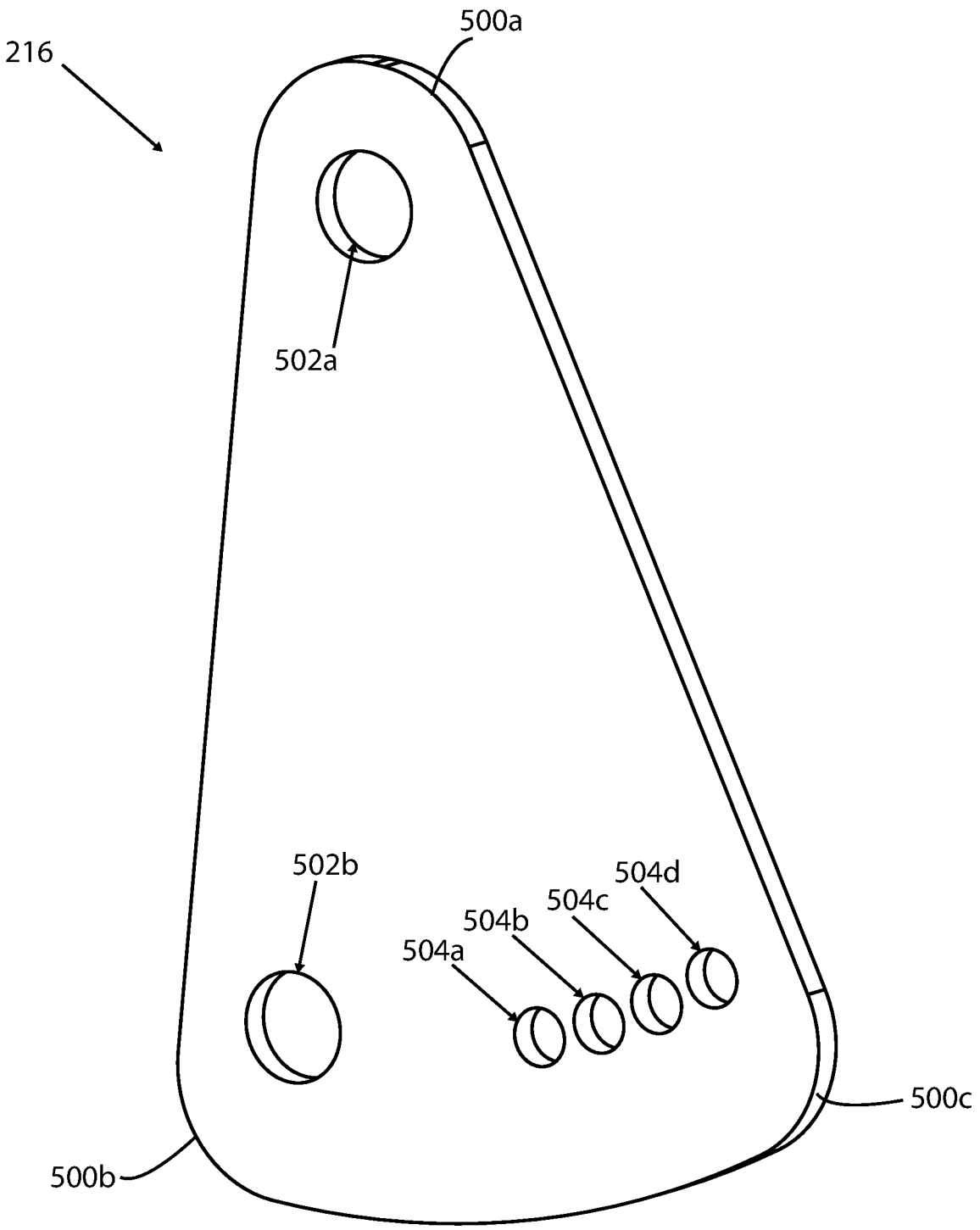
FIG. 5 illustrates a frontal view of an exemplary adjustment bracket forming mount holes and bracket holes, in accordance with an embodiment of the present invention.

Turning now to FIG. 5, device 200 provides at least one adjustment bracket 216 that serves as a buffer, of sorts between the rollator handle and the handle bar 202. Two adjustment brackets may be used on each rollator handle. In some embodiments, adjustment bracket 216 is defined by a generally flat configuration with a triangular shape. However, a square, rectangular, circular, or irregular shape may also be used.

In one possible embodiment, adjustment bracket 216 is defined by a flat, triangular shape having an apex corner region 500*a* and a pair of base corner regions 500*b*, 500*c*. The apex corner region 500*a*, and area therearound, forms a first mount hole 502*a* used for mounting to rollator handle 104*a*-*b*. One of the apex corner regions 500*b*, and area therearound, forms a second mount hole 502*b* that is used for mounting to rollator handle 104*a*-*b*. The other apex corner region 502*c*, and area therearound, forms multiple spaced-apart bracket holes 504*a*, 504*b*, 504*c*, 504*d* used for height adjusting the handle bar 202. In some embodiments, holes 502*a*-*b*, 504*a*-*d* may have a generally circular shape.

Figure 6:
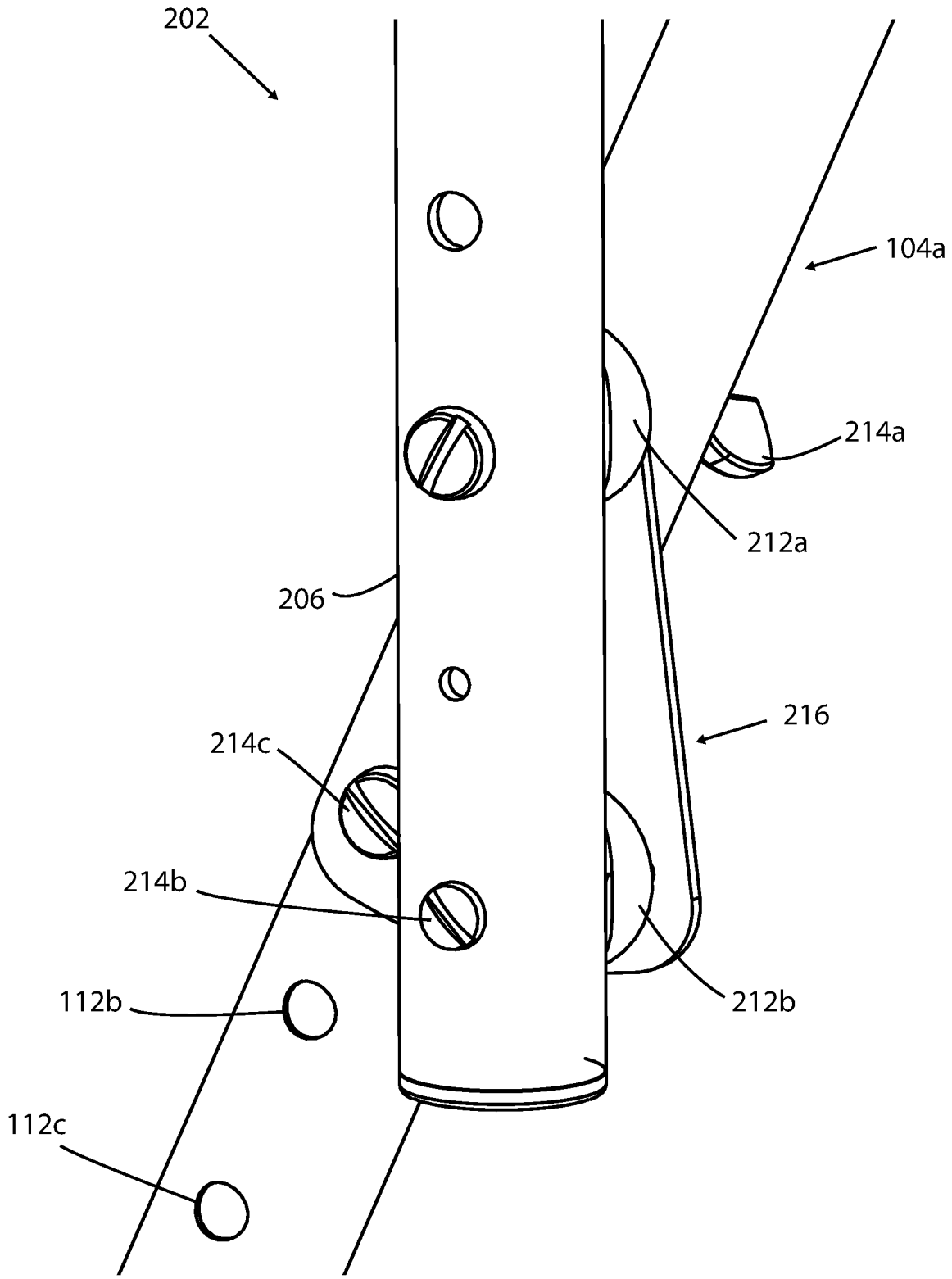
FIG. 6 illustrates a sectioned view of the handle bar, the adjustment bracket, and the rollator handle fastened together at a unique height and position for the handle bar, in accordance with an embodiment of the present invention.

As FIG. 6 illustrates, adjustment bracket 216 fits between the handle bar 202 and the rollator handle 104*a*-*b*. Adjustment bracket 216 is configured to create a frictionless pivoting articulation of the handle bar 202 relative to rollator handle 104*a*-*b*. Adjustment bracket 216 is also configured to enable the handle bar 202 to be fixedly oriented at a set angle relative to the rollator handle. In this manner, the adjustment bracket 216 allows the handle bar 202 to be positioned in at least four angle adjustment positions relative to the rollator handle 104*a*-*b*. Each position correlates to a bracket hole 504*a*-*d* being aligned with a fastening hole 300*a*-*d* formed in handle bars 202.

In some embodiments, adjustment bracket 216 fixedly attaches handle bar 202 to the frame 102 of rollator through use of a first and second mount hole 502*a*, 502*b*. Mount holes 502*a*-*b* are configured to align with the rollator fastening holes 112*a*-*c*. In mounting, adjustment bracket 216 is moved along the length of the rollator handle 104*a* to a desired position for mounting thereto. Device 200 provides at least one fastener 214*a-c* that passes through the mount holes 502*a-b* and the rollator fastening holes 112*a-c*, so as to secure the adjustment bracket 216 to rollator handle 104*a-b*.

Similarly, bracket holes 504*a-d* that form in adjustment bracket 216, and fastening holes 300*a-d* that form in the distal section 206 of the handle bar 202 are aligned to a desired height for the handle bar 202. Fastener 214*a-c* passes through the fastening holes 300*a-d* and bracket holes 504*a-d* (See FIG. 6) and then tightens to secure handle bar 202 into position. This fastening means serves to fixedly set the height and position of the handle bar 202 relative to the adjustment bracket 216.

Thus, fastener 214*a-c* passes through rollator fastening holes 112*a-c*, mount holes 502*a-b*, bracket holes 504*a-d*, and handle bar fastening holes 300*a-d* to fix the position and height of handle bars 202 to rollator handle 104*a-b*. For example, FIG. 6 illustrates a sectioned view of the handle bar, the adjustment bracket, and the rollator handle fastened together at a unique height and position for handle bar 202.

For example, a taller user may raise the handle bar 202 so that the bottom fastening hole 300*d* of handle bar 202 aligns with the top bracket hole 504*a*, and then set the position with fastener 214*a*. In this manner, handle bar 202 is at the maximum height, and the proximal section 204 is easier for the taller user to grip. Thus, handle bar 202 attaches to adjustment bracket 216 by selectively passing and fastening the fastener to one of the bracket holes and fastening holes, at a desired length and angle. This allows handle bar 202 to attach to rollator handle 104*a-b*, and be easily set at an ideal angle for user to manipulate and receive support from rollator 100.

In some embodiments, fastener 214*a-c* may include, without limitation, threaded bolts, butterfly screws, winged bolt, nuts, and friction fit fasteners. In one embodiment, fastener 214*a-c* is configured to be turned with a coin or fingers through use of a slot at the ends, and a butterfly screw at an opposing end. Fastener 214*a-c* is loosened to realign the fastening holes and bracket holes. Fastener 214*a-c* may also be loosened to adjust the angle of the handle bar 202 relative to rollator handle 104*a-b*. Furthermore, device 200 may include at least one spacer 212*a*, 212*b* can be used to separate adjustment bracket 216 from handle bar 202. Spacer helps prevent frictional interference therebetween. In some embodiments, spacer 212*a-b* may include a metal or polymer circular component having a central opening to enable passage of fastener 214*a-c*.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A position-adjustable accessory handle device, the device comprising:

at least one handle bar defined by a proximal section, a distal section, and an arced bridge, the arced bridge being integral with and extending between the proximal and distal sections, the arced bridge forming an arc angle, the distal section forming multiple spaced-apart fastening holes;

at least one adjustment bracket defined by a triangular shape having an apex corner region and a pair of base corner regions, the apex corner region forming a first mount hole, one of the apex corner regions forming a second mount hole, the other apex corner region forming multiple spaced-apart bracket holes, the adjustment bracket disposed flush with the distal section of the handle bar, whereby at least one of the fastening holes of the handle bar align with at least one of the bracket holes of the adjustment bracket; and at least one fastener operational to pass through one of each of the aligned fastening and bracket holes for fixedly fastening the handle bar to the adjustment bracket, whereby the position of the handle bar relative to the adjustment bracket is adjustable based on the holes selected to receive the fastener.

2. The device of claim 1, further comprising a rollator, the rollator comprising a frame and a pair of rollator handles, the rollator handles forming multiple rollator fastening holes.

3. The device of claim 2, wherein the at least one adjustment bracket is operational to fasten to the rollator handles.

4. The device of claim 3, wherein the first and second mount holes of the adjustment bracket align with the rollator fastening holes of the rollator handles.

5. The device of claim 4, wherein the at least one fastener is operational to pass through one of each of the aligned mount and rollator fastening holes for fixedly fastening the adjustment bracket to the rollator handle.

6. The device of claim 2, wherein the rollator further comprises a support bar and multiple wheels or rollers.

7. The device of claim 1, wherein multiple handle bars, each having a unique arced bridge defined by a different arc angle, detachably and interchangeably attach to the rollator handles.

8. The device of claim 1, wherein the proximal section of the handle bar is shorter than the distal section.

9. The device of claim 1, wherein the fastening holes are spaced about one inch apart.

10. The device of claim 9, wherein the bracket holes are spaced about one inch apart.

11. The device of claim 1, wherein the multiple bracket holes comprises four bracket holes.

12. The device of claim 1, wherein the fastener includes at least one of the following: a threaded bolt, a butterfly screw, a winged bolt, a nut, and a friction fit fastener.

13. The device of claim 1, further comprising at least one spacer disposed between the adjustment bracket and the distal section of the handle bar.

14. The device of claim 1, further comprising at least one grip member joined with the proximal section of the handle bar.

15. A position-adjustable accessory handle device, the device comprising:

at least one handle bar defined by a proximal section, a distal section, and an arced bridge, the arced bridge being integral with and extending between the proximal and distal sections, the arced bridge forming an arc angle, the distal section forming multiple spaced-apart fastening holes;

at least one grip member joined with the proximal section of the handle bar;

at least one adjustment bracket defined by a triangular shape having an apex corner region and a pair of base corner regions, the apex corner region forming a first mount hole, one of the apex corner regions forming a second mount hole, the other apex corner region forming multiple spaced-apart bracket holes, the adjustment bracket disposed flush with the distal section of the handle bar, whereby at least one of the fastening holes of the handle bar align with at least one of the bracket holes of the adjustment bracket, the at least one adjustment bracket being operational to fasten to a pair of rollator handles of a rollator, whereby the first and second mount holes of the adjustment bracket align with multiple rollator fastening holes of the rollator handles;

at least one fastener operational to pass through one of each of the aligned fastening and bracket holes for fixedly fasten the handle bar to the adjustment bracket, whereby the position of the handle bar relative to the rollator handles is adjustable based on the holes selected to receive the fastener, whereby the at least one fastener is operational to pass through one of each of the aligned mount and rollator fastening holes for fixedly fastening the adjustment bracket to the rollator handle; and at least one spacer disposed between the adjustment bracket and the distal section of the handle bar.

16. The device of claim 15, wherein the rollator further comprises a frame and multiple wheels.

17. The device of claim 15, wherein the proximal section of the handle bar is shorter than the distal section.

18. The device of claim 15, wherein the fastening holes are spaced about one inch apart.

19. The device of claim 18, wherein the bracket holes are spaced about one inch apart.

20. A position-adjustable accessory handle device, the device comprising:

multiple handle bars defined by a proximal section, a distal section, and an arced bridge, the arced bridge being integral with and extending between the proximal and distal sections, the arced bridge forming an arc angle, each handle bar having a unique arced bridge defined by a different arc angle, the proximal section of the handle bar being shorter than the distal section, the distal section forming multiple spaced-apart fastening holes, the fastening holes being spaced about one inch apart;

at least one grip member joined with the proximal section of the handle bar;

at least one adjustment bracket defined by a triangular shape having an apex corner region and a pair of base corner regions, the apex corner region forming a first mount hole, one of the apex corner regions forming a second mount hole, the other apex corner region forming four spaced-apart bracket holes, the adjustment bracket disposed flush with the distal section of the handle bar, whereby at least one of the fastening holes of the handle bar align with at least one of the bracket holes of the adjustment bracket, the at least one adjustment bracket being operational to fasten to a pair of rollator handles of a rollator, whereby the first and second mount holes of the adjustment bracket align with multiple rollator fastening holes of the rollator handles;

at least one fastener operational to pass through one of each of the aligned fastening and bracket holes for fixedly fasten the handle bar to the adjustment bracket, whereby the position of the handle bar relative to the rollator handles is adjustable based on the holes selected to receive the fastener, whereby the at least one fastener is operational to pass through one of each of the aligned mount and rollator fastening holes for fixedly fastening the adjustment bracket to the rollator handle, whereby the multiple handle bars with the different arced bridges defined by unique arc angles are interchangeably fastened to the rollator handle; and at least one spacer disposed between the adjustment bracket and the distal section of the handle bar.

* * * * *